US005346499A

United States Patent [19]

Garenfeld et al.

[11] Patent Number: 5,346,499

[45] Date of Patent: Sep. 13, 1994

[54] DEPILATION APPARATUS AND METHOD USING A VIBRATION MEMBER TO AFFECT THE FUNCTION OF NERVES IN THE SKIN

[75] Inventors: Andreas J. Garenfeld, Eindhoven; Robert H. Munnig Schmidt, Groningen, both of Netherlands

[73] Assignee: U.S. Philips Corporation, New York, N.Y.

[21] Appl. No.: 56,596

[22] Filed: May 3, 1993

Related U.S. Application Data

[63] Continuation of Ser. No. 808,332, Dec. 16, 1991.

[30] Foreign Application Priority Data

Feb. 28, 1991 [NL] Netherlands ..... 9002770

[51] Int. Cl.[5] ..... A45D 26/00

[52] U.S. Cl. ..... 606/133; 606/131; 601/101

[58] Field of Search ..... 606/131, 133; 128/51, 128/898

[56] References Cited

U.S. PATENT DOCUMENTS

| | | | |
|---|---|---|---|
| 4,988,353 | 1/1991 | Gross | 606/133 |
| 5,011,485 | 4/1991 | Daar et al. | 606/133 |
| 5,084,056 | 1/1992 | Eckel et al. | 606/133 |
| 5,108,410 | 4/1992 | Iwasaki et al. | 606/133 |

*Primary Examiner*—Stephen C. Pellegrino
*Assistant Examiner*—Glenn K. Dawson
*Attorney, Agent, or Firm*—Ernestine C. Bartlett

[57] ABSTRACT

A depilation method whereby hairs are gripped and pulled from the skin by means of a depilation member. Immediately prior to depilation, a vibration member is brought into contact with the skin to be depilated, which member exerts forces of varying intensity on the skin whereby the nerve function in the skin is affected.

16 Claims, 2 Drawing Sheets

DEPILATION APPARATUS AND METHOD USING A VIBRATION MEMBER TO AFFECT THE FUNCTION OF NERVES IN THE SKIN

This is a continuation division of application Ser. No. 07/808,332, filed Dec. 16, 1991.

FIELD OF THE INVENTION

The invention relates to a depilation method whereby hairs are gripped and pulled from the skin by means of a depilation member.

Such a method may be carried out, for example, with an apparatus as described in EP-A-381 875 which corresponds substantially to U.S. Pat. No. 5,041,122 commonly assigned herewith. A disadvantage of such a depilation method is that it is practically always painful.

BACKGROUND OF THE INVENTION

An object of the invention is to counteract and, if possible, completely eliminate the pain sensation which is experienced during a depilation method whereby hairs are gripped and pulled from the skin as described above. The method according to the invention is characterized in that immediately prior to depilation a vibration member is brought into contact with the skin to be depilated, which member exerts forces of varying intensity on the skin whereby the nerve function in the skin is affected.

The varying forces activate the nerves situated near a hair root. Owing to a sluggishness in the functioning of the nervous system, the nerves are incapable of reacting once more for a short time after this. If pulling out of the hair takes place during this short time, no pain will be caused. This phenomenon also occurs when the varying forces are only small, i.e. when the amplitude of these forces is so small that the pain sensation caused by them lies far below the level of the pain sensation which occurs when a hair is pulled out.

The invention has also been defined as an apparatus for carrying out the method according to the invention wherein:

comprising a depilation member and a vibration member for exerting varying forces on the skin to be depilated whereby immediately prior to depilation the vibration member exerts forces of sufficient intensity on the skin that the nerve function is affected. In preferred embodiments of the invention, the apparatus may contain any and all of the following features:

(a) the varying forces are exerted on the skin with a frequency between 5 and 1,000 Hz;

(b) there is present a vibration member for exerting varying forces on the skin to be depilated;

(c) the housing comprises an electric motor which is coupled to the vibration member;

(d) the housing is provided with a screening element with hair passage openings at the area of the depilation member, the screening member being movable relative to the housing and at the same time forming the vibration member;

(e) the housing is provided with a mouthpiece within which the depilation member is situated, wherein the mouthpiece is movable relative to the housing, and at the same time forms the vibration member;

(f) the depilation member is mounted so as to be movable relative to the housing and at the same time forms the vibration member.

BRIEF DESCRIPTION OF THE DRAWINGS

The invention will be explained below by means of a description of an embodiment represented in the Figures.

DETAILED DESCRIPTION OF THE PREFERRED EMBODIMENTS

Figure 1:
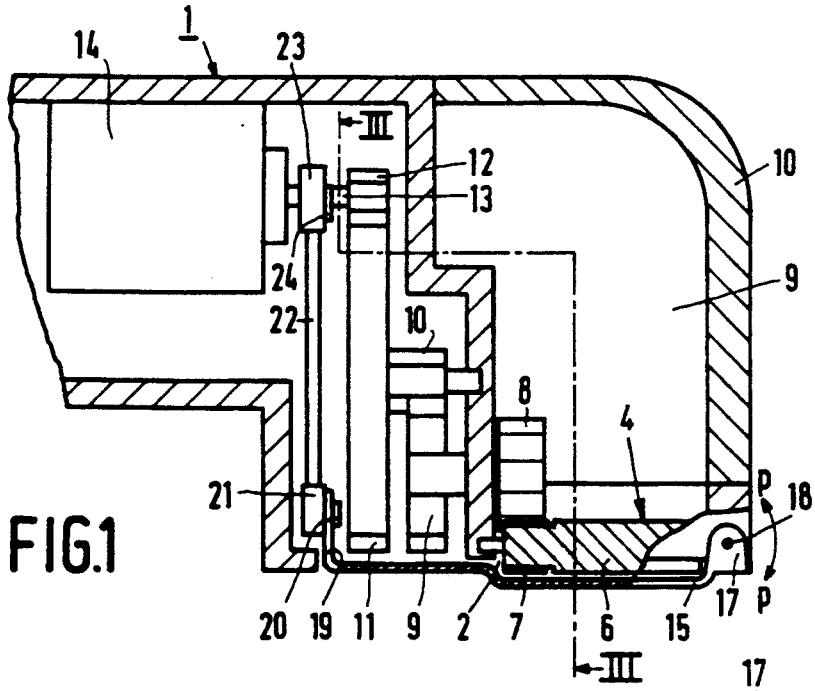
FIG. 1 shows a depilation apparatus for carrying out the method according to the invention in a cross-section taken on the line I—I in FIG. 2.
Figure 2:
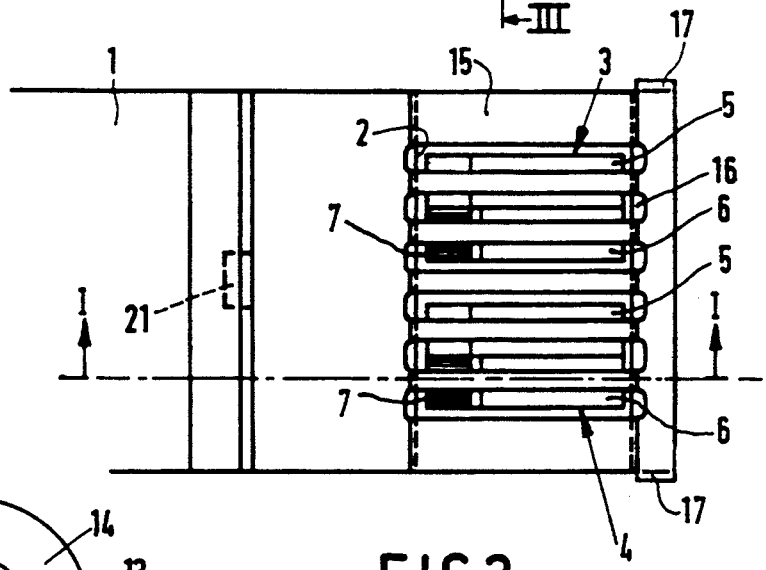
FIG. 2 is a bottom view of the depilation apparatus of FIG. 1.
Figure 3:
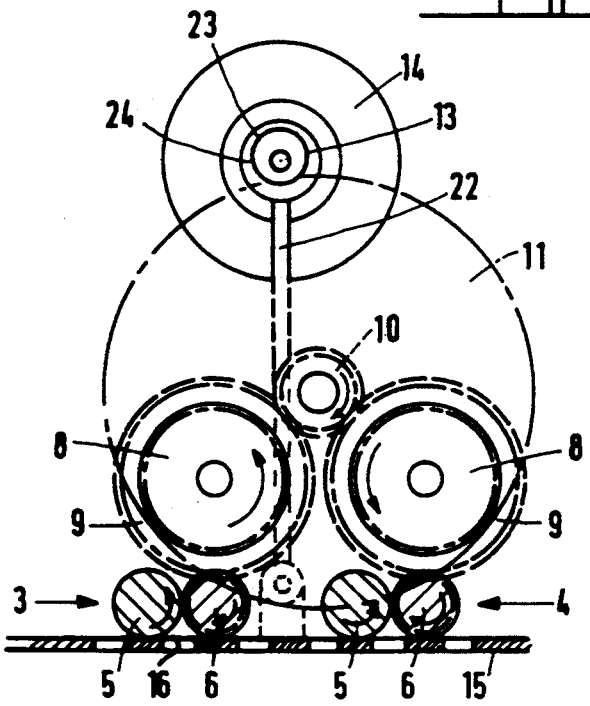
FIG. 3 diagrammatically shows a cross-section taken on the line III—III in FIG. 1.

The apparatus shown in FIGS. 1, 2 and 3 comprises a housing 1 with an opening 2 in which two depilation members 3 and 4 are situated. These depilation members 3 and 4 each consist of a pair of rollers 5, 6 which have their rotation bearings in the housing. Each roller 5 is provided with a gear 7 which is coupled to the pinion 12 on the shaft 13 of the drive motor 14 by means of the gears 8, 9, 10 and 11. The friction between the rollers 5 and 6 of a depilation member 3 and 4 also causes the rollers 6 to rotate. The direction of rotation is such that the direction of movement in the location where the rollers 5, 6 of a depilation member 3 or 4 come into contact towards the interior of the apparatus. A hair which gets clamped between the rollers 5 and 6 of a depilation member is pulled from the skin as a result.

The apparatus is provided with a screen plate 15 with hair passage openings 16 to prevent the skin from getting between the rollers 5 and 6.

This screen plate 15 is provided with bent-back lugs 17 so that the plate can pivot about the pins 18 at the housing 1. At the opposite end, the screen plate 15 is provided with a bent tag 19 with a stub 20 about which an end 21 of an arm 22 is pivoted. The other end 23 of the arm 22 has its pivot points on the eccentric 24 on the shaft 13 of the drive motor 14. The screen plate 15 thus at the same time forms a vibration member which can be driven by the motor 14 with a rotary oscillating movement P around the pins 18.

By placing the apparatus on the skin to be depilated, it is possible to exert varying forces on the skin with the vibration member 15, so that the function of the nerves of the skin is affected. Owing to the sluggishness described above, the occurrence of pain during pulling-out of a hair can be counteracted in this way.

A pain reduction is in addition obtained as a result of a kind of fatigue effect. It has been found in fact that the transfer of the pain signal between the nerve in the skin and the brain is also impaired at frequencies of the varying forces of between 5 and 1,000 Hz, in dependence on the amplitude.

A third cause by which pain is suppressed in the method described is the known phenomenon that a slight stimulation of a nerve end suppresses the operation of an adjoining nerve end. It was found in practice that amplitudes of the vibration member of a few millimeters are effective. In the embodiment described here, the amplitude of the screen plate 15 resulting from its fastening to the housing with rotation possibility is not equally large everywhere. The screen plate, however, may also be fastened to the housing in such a way that a translation relative to the housing is possible.

Alternatively, the apparatus may be provided with a separate vibration member, or a mouthpiece, surrounding the opening 2 and constructed so as to be movable relative to the housing 1, may act as the vibration member.

Figure 4:
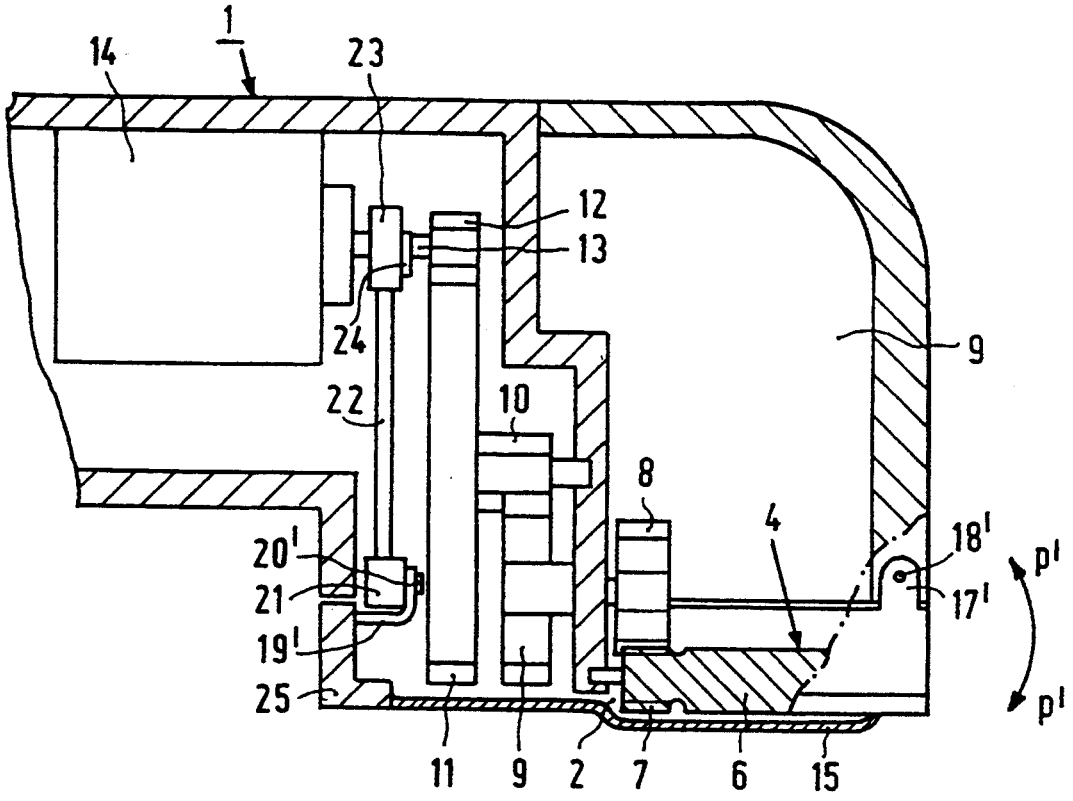
FIG. 4 shows another depilation apparatus for carrying out the method of the invention in a cross-section similar to that shown in FIG. 1.

Such an embodiment is illustrated in FIG. 4 in which the apparatus includes a mouthpiece 25 which is pivotable about pins 18' at the housing 1. At the opposite end, the mouthpiece 25 is provided with a bent tag 19' with a stub 20' about which the end 21 of the arm 22 is pivoted. Such a construction is very similar to that illustrated in FIG. 1 in which the screen plate 15 is pivotable so as to form the vibration member. In the embodiment of FIG. 4, the mouthpiece 25 is driven by the motor 14 with a rotary oscillating movement P' around the pins 18', thereby forming the vibration member.

Finally, an embodiment is included in which the depilation member is mounted in such a way as to be movable in a direction substantially perpendicular to the skin relative to the housing and at the same time forms the vibration member.

We claim:

1. A depilation method whereby hairs are gripped and pulled from the skin by means of a depilation member, wherein immediately prior to depilation a vibration member which is driven by a motor with a movement relative to a housing to which said vibration member is attached, is brought into contact with the skin to be depilated, which vibration member exerts forces of sufficient intensity on the skin that the function of nerves in the skin is affected.

2. An apparatus for gripping hairs and pulling them from the skin, said apparatus comprising a housing with an opening, a depilation member supported in said opening, a vibration member for exerting varying forces on the skin to be depilated, a motor in said housing comprising a drive shaft, and means operatively associated with said drive shaft of said motor, said depilation member and said vibration member for driving said depilation member and for effecting a pivotal movement of said vibration member relative to at least a portion of the housing, whereby immediately prior to depilation the vibration member is brought into contact with the skin to be depilated, which vibration member exerts forces of sufficient intensity on the skin that the function of nerves in the skin is affected.

3. An apparatus as claimed in claim 2, in which said motor is an electric motor and wherein the electric motor is also coupled to the vibration member.

4. An apparatus as claimed in claim 3 wherein the housing is provided with a screening member with hair passage openings adjacent of the depilation member, the screening member being movable relative to the housing and at the same time forming the vibration member.

5. An apparatus as claimed in claim 4 wherein the a housing is provided with a mouthpiece within which the depilation member is situated, the mouthpiece being movable relative to the housing and at the same time forming the vibration member.

6. An apparatus as claimed in claim 2, in which said housing is provided with a screening element with hair passage openings at the area of the depilation member, the screening element being movable relative to the housing and at the same time forming the vibration member.

7. An apparatus as claimed in claim 2, comprising a housing having a mouthpiece within which the depilation member is situated, wherein the mouthpiece is movable relative to the housing, and at the same time forms the vibration member.

8. A depilation method whereby hairs are gripped and pulled from the skin by means of a depilation member wherein immediately prior to depilation a vibration member which is driven by a motor with a movement relative to a housing to which said vibration member is attached is brought into contact with the skin to be depilated, which vibration member exerts forces of sufficient varying intensity on the skin that the function of nerves in the skin is affected, said varying forces being exerted on the skin with a frequency between 5 and 1,000 Hz.

9. An apparatus for gripping hairs and pulling them from the skin comprising a housing with an opening, a depilation member supported in said opening, a motor in said housing, a vibration member for exerting varying forces on the skin to be depilated, and means operatively associated with said motor, said depilation member and said vibration member for driving said depilation member and for effecting a pivotal movement of said vibration member relative to said housing, whereby immediately prior to depilation the vibration member exerts forces of sufficient intensity on the skin that the function of nerves in the skin is affected, said forces being exerted on the skin with a frequency between 5 and 1,000 Hz.

10. An apparatus as claimed in claim 9, wherein said motor is an electric motor and is accommodated for driving the depilation member and wherein the electric motor is also coupled to the vibration member.

11. An apparatus as claimed in claim 10 wherein the housing is provided with a screening member with hair passage openings adjacent of the depilation member, the screening member being movable relative to the housing and at the same time forming the vibration member.

12. An apparatus as claimed in claim 10, wherein the housing is provided with a mouthpiece within which the depilation member is situated, the mouthpiece being movable relative to the housing and at the same time forming the vibration member.

13. An apparatus as claimed in claim 9 wherein said housing is provided with a screening member having hair passage openings adjacent the depilation member and wherein the screening member is movable relative to the housing and at the same time forms the vibration member.

14. An apparatus as claimed in claim 11 wherein said housing is provided with a mouthpiece within which the depilation member is situated and wherein the mouthpiece is movable relative to the housing, and at the same time forms the vibration member.

15. An apparatus for gripping hairs and pulling them from the skin, said apparatus comprising a housing with an opening, a depilation member supported in said opening, a vibration member for exerting varying forces on the skin to be depilated, and a motor in said housing comprising a drive shaft, said vibration member being in the form of a screen plate that has at least two ends, which screen plate at one end pivots about pins contained in the housing and at the other end pivots about a stub connected to an eccentric located on the drive shaft of the motor, whereby immediately prior to depilation the vibration member is brought into contact with the skin to be depilated, which vibration member exerts forces of sufficient intensity on the skin that the function of nerves in the skin is affected.

16. An apparatus for gripping hairs and pulling them from the skin, said apparatus comprising a housing with an opening, a depilation member supported in said opening, a vibration member for exerting varying forces on the skin to be depilated, and a motor in said housing comprising a drive shaft, said vibration member being in the form of a mouthpiece that has at least two ends, which mouthpiece at one end pivots about pins contained in the housing and at the other end pivots about a stub connected to an eccentric located on the drive shaft of the motor, whereby immediately prior to depilation the vibration member is brought into contact with the skin to be depilated, which vibration member exerts forces of sufficient intensity on the skin that the function of nerves in the skin is affected.

* * * * *